US010868349B2

(12) United States Patent
Oppenlaender et al.

(10) Patent No.: US 10,868,349 B2
(45) **Date of Patent: *Dec. 15, 2020**

(54) CONTROLLABLE PHASE CONTROL ELEMENT FOR ELECTROMAGNETIC WAVES

(71) Applicant: Lisa Draexlmaier GmbH, Vilsbiburg (DE)

(72) Inventors: Joerg Oppenlaender, Kirchentellinsfurt (DE); Alexander Moessinger, Tuebingen (DE)

(73) Assignee: Lisa Dräxlmaier GmbH, Vilsbiburg (DE)

( * ) Notice: Subject to any disclaimer, the term of this patent is extended or adjusted under 35 U.S.C. 154(b) by 53 days.

This patent is subject to a terminal disclaimer.

(21) Appl. No.: 16/316,214

(22) PCT Filed: Jun. 27, 2017

(86) PCT No.: PCT/EP2017/065890
§ 371 (c)(1),
(2) Date: Jan. 8, 2019

(87) PCT Pub. No.: WO2018/007212
PCT Pub. Date: Jan. 11, 2018

(65) Prior Publication Data

US 2020/0112074 A1 Apr. 9, 2020

(30) Foreign Application Priority Data

Jul. 8, 2016 (DE) ..... 10 2016 112 583

(51) Int. Cl.
*H01P 1/17* (2006.01)
*H01P 1/18* (2006.01)

(52) U.S. Cl.
CPC ..... *H01P 1/172* (2013.01); *H01P 1/182* (2013.01)

(58) Field of Classification Search
CPC ..... H01P 1/172; H01P 1/182
(Continued)

(56) References Cited

U.S. PATENT DOCUMENTS 2,438,119 A 3/1948 Fox
2,546,840 A 3/1951 Tyrrell
6,166,610 A * 12/2000 Ramanujam ..... H01P 1/17 333/161

FOREIGN PATENT DOCUMENTS

DE 3741501 C1 2/1989
DE 3920563 A1 1/1991
(Continued)

OTHER PUBLICATIONS

Translation of DE102010014916 (A1).
(Continued)

*Primary Examiner* — Robert J Pascal
*Assistant Examiner* — Kimberly E Glenn
(74) *Attorney, Agent, or Firm* — Jacob Eisenberg

(57) ABSTRACT

A controllable phase control element comprises a drive unit and a holder, to which at least two polarizers are attached, which are arranged one behind the other in the direction of incidence of a wave. Each polarizer is designed in such a way that the polarizer can convert a circularly polarized signal into a linearly polarized signal. The drive unit is designed in such a way that the holder and thus the polarizers can be mounted over a freely selectable angular range.

19 Claims, 11 Drawing Sheets

Figure 1:
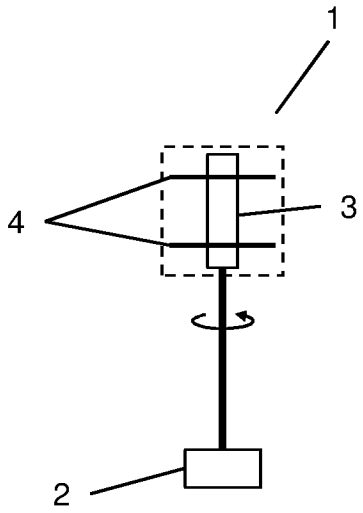

(58) Field of Classification Search
USPC ..... 333/21 A
See application file for complete search history.

(56) References Cited

FOREIGN PATENT DOCUMENTS

| | | | |
|---|---|---|---|
| DE | 102010014916 | A1 | 10/2011 |
| EP | 0 196 081 | A2 | 10/1986 |
| JP | 55-102901 | A | 8/1980 |
| JP | 01-126803 | | 5/1989 |
| JP | 33-43408 | | 8/2002 |

OTHER PUBLICATIONS

Brand, G.F., "A New Millimeter Wave Geometric Phase Demonstration", International Journal of Infrared and Millimeter Waves, vol. 21, No. 4, 2000, pp. 505-518.
Sipal, V., et al., "Using Near-Field Coupled Circularly Polarised Antennas as Frequency-Independent Variable Phase Shifters", Electronics Letters, May 22, 2014, vol. 50, No. 11, pp. 788-790.
Mirzabekyan, E.G., et al., "Rotation of the Polarization Plane in a Circular Waveguide", Instruments and Experimental Techniques, vol. 16, Jun. 1973, pp. 820-821.
International Search Report for corresponding International Application No. PCT/EP2017/065890 dated Sep. 14, 2017 (20 pages).
Office Action of corresponding German Patent Application No. 10 2016 112 583.0 dated Feb. 24, 2017 (8 pages).

* cited by examiner

CONTROLLABLE PHASE CONTROL ELEMENT FOR ELECTROMAGNETIC WAVES

The invention relates to a controllable phase control element for electromagnetic waves, in particular for the GHz frequency range and in particular for antennas.

Controllable phase control elements ("phase shifters") are used in many RF systems in signal processing. An important area of application is antennas or antenna systems, which primarily involves the phase-coherent superposition of signals.

Thus it is known that with the aid of controllable phase control elements ("phase shifters"), the antenna orientation diagram of stationary antenna groups can be spatially varied. For instance, the primary beam can be pivoted in various directions. The phase control elements in so doing vary the relative phase position of the signals that are received or sent by various individual antennas of an antenna array. If the relative phase position of the signals of the individual antennas is adjusted accordingly with the aid of the phase control elements, then the primary beam ("main beam") of the antenna diagram of the antenna array points in the desired direction.

In antenna arrays on mobile carriers, such as motor vehicles, aircraft or ships, for example, phase control has the object of always orienting the main beam of the antenna arrays optimally at a target during the spatial motion of the mobile carrier.

Conversely, as for instance in stationary radar antennas, a moving target can be followed with the aid of phase control.

The currently known phase actuators are mostly constructed of nonlinear solid bodies ("solid state phase shifters"), mostly ferrites, microswitches (MEMS technology, binary switches), or liquid crystals ("liquid cristals").

All of these technologies, however, have the disadvantage that on the one hand they often lead to considerable signal loss, since some of the high-frequency power is dissipated in the phase actuators. Particularly in applications in the GHz range, the antenna efficiency of the antenna arrays drops sharply as a result.

Furthermore, phase-controlled antenna arrays in which conventional phase actuators are used are very expensive. Particularly for civilian applications above 10 GHz, this prevents their use.

A further problem is the demands made for accurate control of the antenna diagram of the antenna arrays. If the antenna arrays are used in radio link applications with satellites, then stringent demands are made in terms of the regulatory conformity of the antenna diagram. For every primary beam direction, the diagram in the sending mode must be faithful to the regulatory mask. This can be ensured reliably only by providing that every time, both the amplitude and the phase of each individual antenna element of the antenna array are known.

None of the currently known technologies for phase actuators, however, allows reliable instantaneous, that is, immediate determination, without making additional calculation possible, of the phase position of the signal downstream of the phase actuator. To do so would require the ability to determine the status of the phase actuator reliably at all times. However, that is not practically possible with either solid-state or MEMS nor liquid crystal phase actuators.

From DE 37 41 501 C1, a feed system for an antenna is known that can transmit different polarized waves. The feed system uses a fixed 90° phase shifter and a movable 180° phase shifter, so that the phase position of the two waves to one another is adjustable. EP 0 196 081 A2 shows a high-frequency coupler with a plurality of sequentially arranged phase shifters. From DE 39 20 563 A1, a feed system for a parabolic antenna can be found that is mounted on a rotatable holder and includes a polarizer and a polarization shunt.

The object of the invention is therefore to make a controllable phase control element, in particular in the GHz frequency range and in particular for antennas, available, which 1. allows the exact control of the relative phase position of signals;
2. induces no losses, or only very slight losses;
3. at all times allows the instantaneous determination of the phase position of an applied signal; and
4. can be achieved inexpensively.

This object is attained by a controllable phase control element of the invention and an antenna having such a phase control element as defined by the features of claims 1 and 19, respectively. Advantageous refinements of the invention can be found in the dependent claims, specification, and drawings.

Figure 2:
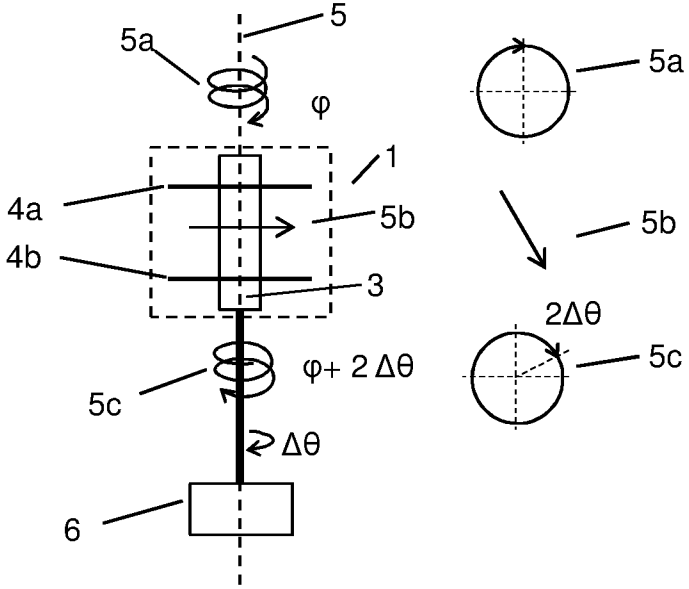
Figure 3:
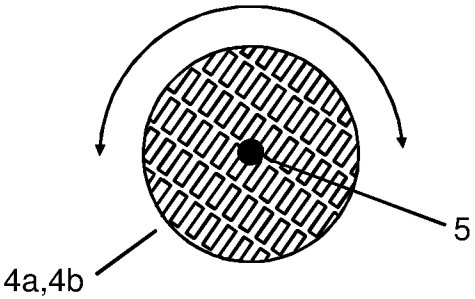
Figure 4:
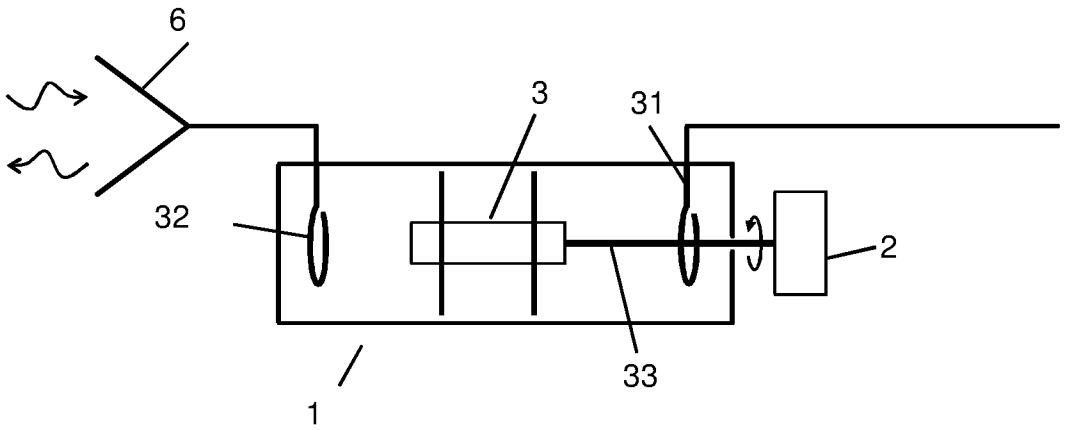
Figure 5:
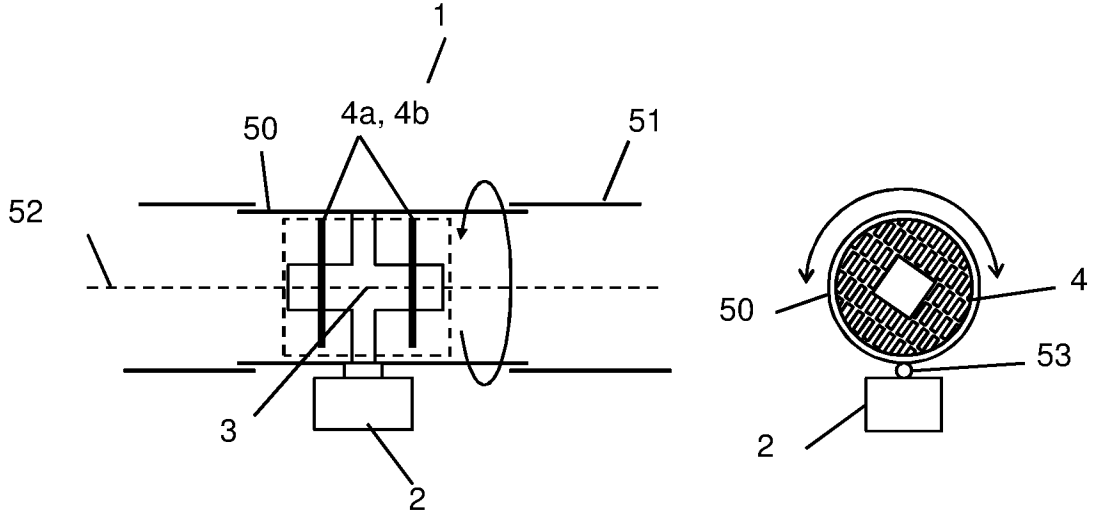
Figure 6:
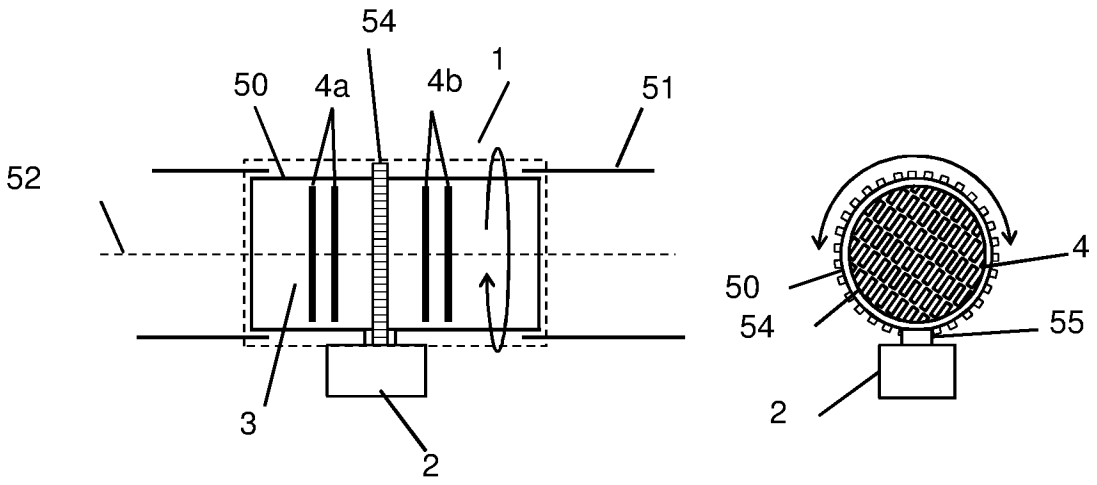
Figure 7:
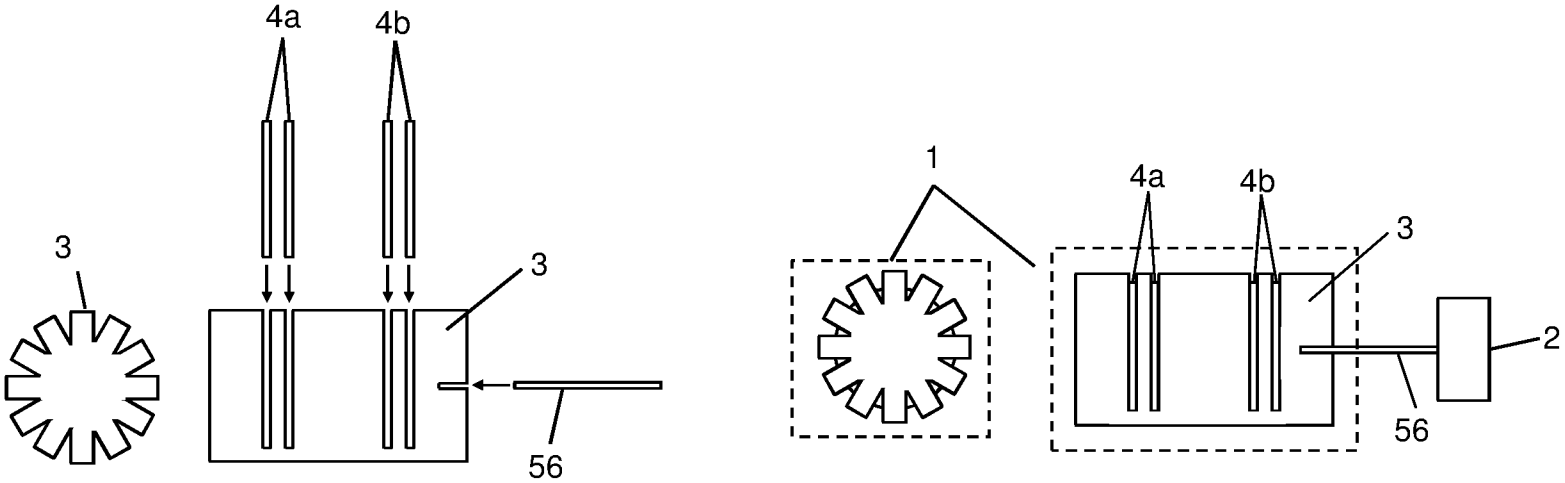
Figure 8:
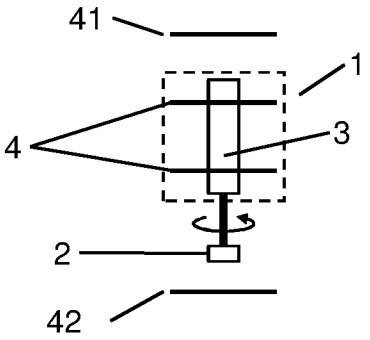
Figure 9:
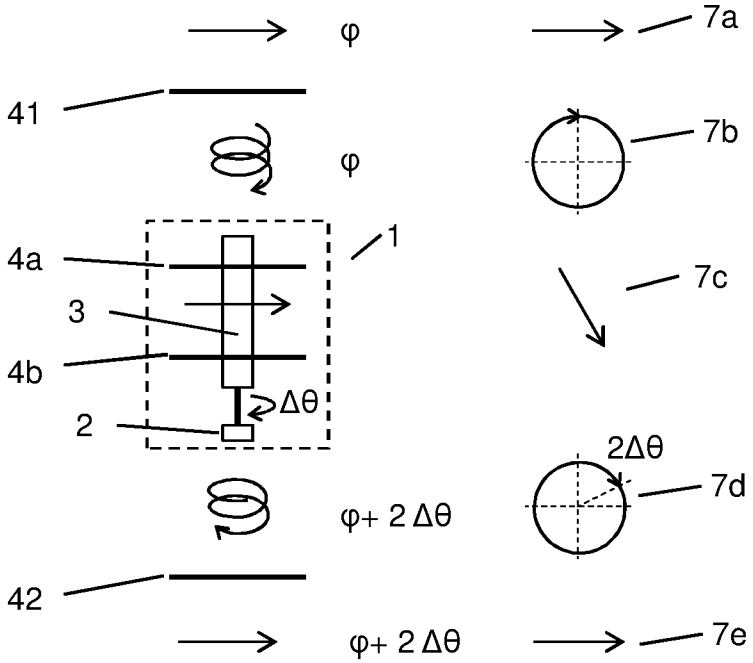
Figure 10:
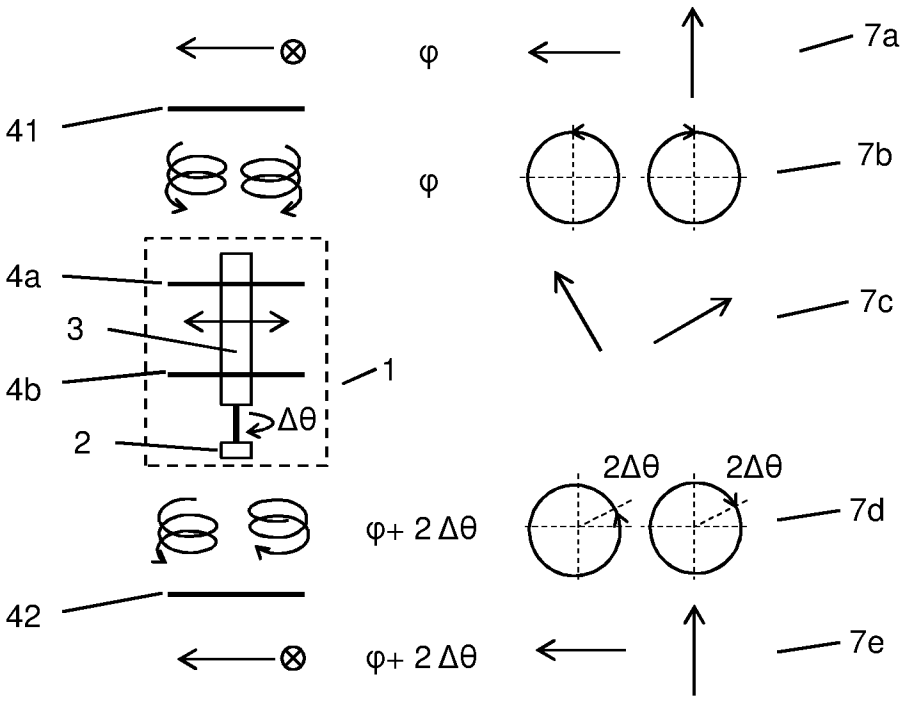
Figure 11:
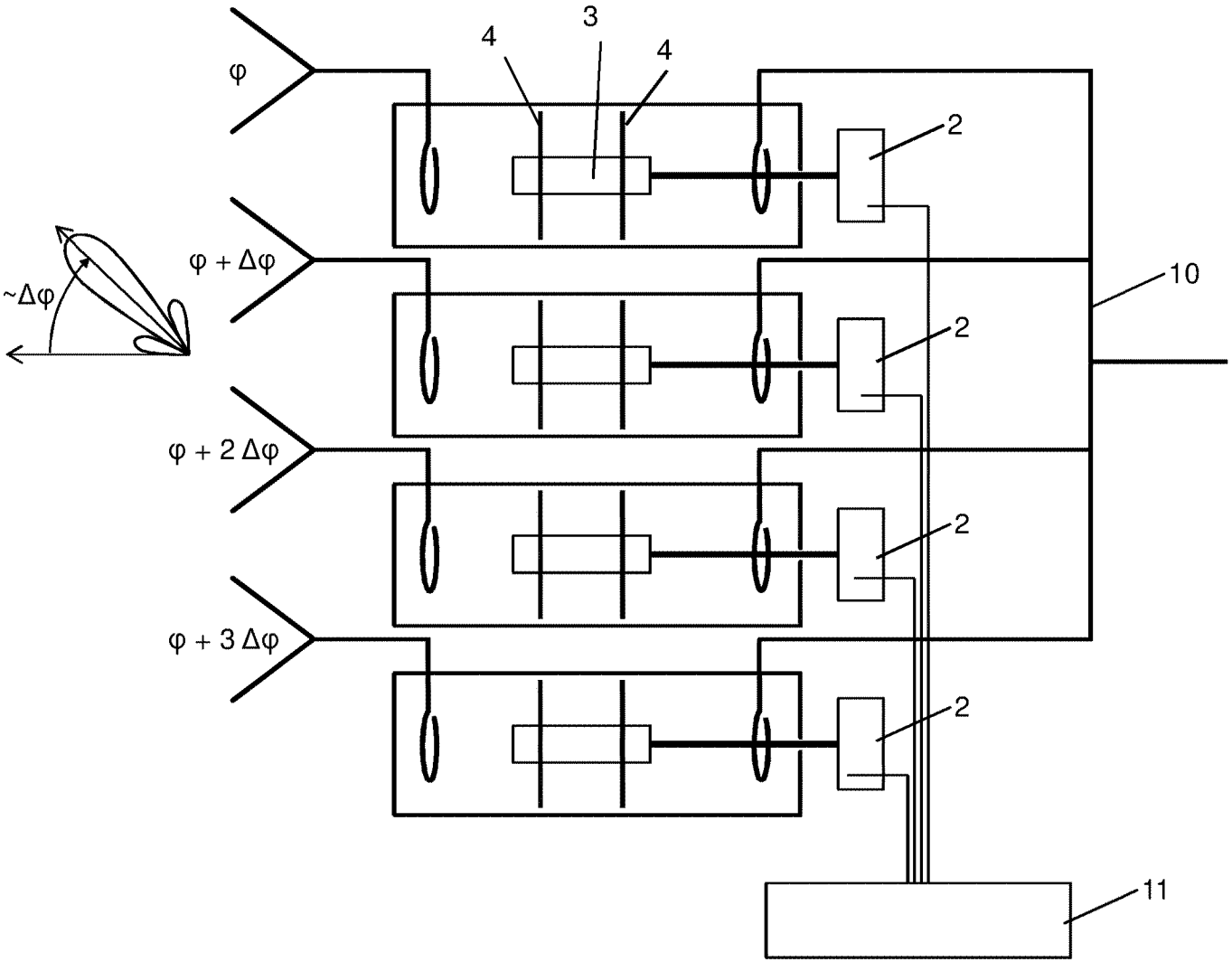

A controllable phase control element according to the invention includes a drive unit (2) and a holder (3), to which at least two polarizers (4), located one after the other in the direction of incidence of a wave, are mounted. Each polarizer (4) is designed such that it can convert a circularly polarized signal into a linearly polarized signal. The drive unit (2) is designed such that the holder (3) can be rotated. Thus the polarizers (4) are rotated as well, specifically by an angle which can be selected freely and which adjusts the phase of the signal as desired. The functional principle is explained in FIG. 1, and the other Figures show the following:

FIG. 2, a phase displacement of a circular wave;

FIG. 3, a polarizer in plan view;

FIG. 4, a phase control element in a waveguide;

FIG. 5, a plurality of phase control elements inside an antenna;

FIG. 6, a further exemplary embodiment of a phase control element with a laterally located drive;

FIGS. 7, 8, further exemplary embodiments of a phase control element with polarizer pairs;

FIGS. 9-11, further exemplary embodiments of a phase control element having additional polarizers and a phase displacement of a circular wave.

The primary mode of function of the invention is shown in FIG. 2. An incident wave (5*a*) with circular polarization and a phase position $\varphi$ is converted by the first polarizer (4*a*) into a linearly polarized wave (5*b*). These waves are converted back into a circularly polarized wave (5*c*) by means of the second polarizer (4*b*).

If the phase control element (1) is now rotated by an angle $\Delta\theta$ with the aid of the drive unit (2), then the polarization vector (5*b*) of the linear wave between the two polarizers (4*a*) and (4*b*) co-rotates with it in a plane perpendicular to the propagation direction. Since the polarizers (4*a*) and (4*b*) likewise co-rotate, the circular wave (5*c*), which is generated by the second polarizer (4*b*), now has a phase position of $\varphi+2\ \Delta\theta$, as can be seen from FIG. 2.

As dictated by the construction of the controllable phase control element of the invention, the dependency of the phase angle difference between the outgoing (5*c*) and incoming (5*b*) circular wave on the rotation of the phase control element (1) is strictly linear, steady, and strictly 2πperiodic. Furthermore, any arbitrary phase rotation or phase shift can be adjusted continuously by the drive unit (2).

Since in terms of electrodynamics the phase control element (1) is advantageously a purely passive component that does not need to include any nonlinear components whatsoever, its function is entirely reciprocal. That is, a wave that runs from bottom to top through the phase control element (1) is rotated in its phase in the same way as a wave that runs from top to bottom through the phase control element (1).

The wave impedance of the arrangement is also, because of its construction, entirely independent of the relative phase position of the incoming and outgoing wave, which is not the case in nonlinear phase shifters, such as semiconductor phase shifters or liquid crystal phase shifters. In them, the wave impedance is dependent on the relative phase position, which makes these components difficult to control.

The at least two polarizers (4*a*) and (4*b*) are preferably mounted perpendicularly to the propagation direction of the incident wave and parallel to one another in the holder (3). The axis of rotation (6) is preferably located in the propagation direction of the incidence wave.

The controllable phase control element here operates practically loss-free, since given suitable design, the losses induced by the polarizers (4*a, b*) and the dielectric holder (3) are very slight. At frequencies of 20 GHz, for example, the entire losses amount to less than 0.2 dB, which is equivalent to an efficiency of more than 95%. Conventional phase shifters, conversely, typically already have losses of several dB at those frequencies.

If the drive unit (2) is furthermore equipped with an angle position transmitter, or if it itself indicates angular positions (as is the case for instance in some piezoelectric motors), then the phase position of the outgoing wave (5*c*) can be instantaneously determined exactly at any time.

Because of the simple construction of the phase control element (1) and because of the fact that only very simply constructed drives (2) are required, the phase control can be achieved very inexpensively. Even a reproduction in great quantities is readily possible.

As drive units (2), both inexpensive electric motors as well as also piezoelectric motors can be considered, or simple actuators which are constructed from electroactive materials.

The polarizers (4*a, b*) can for example comprise simple planar meander polarizers, which are mounted onto a substrate material, such as a high-frequency-capable circuit board. These polarizers can be produced by known etching methods or by additive methods ("circuit printing").

As shown in FIG. 3, the at least two polarizers (4*a*) and (4*b*) preferably have a form that is symmetrical to the axis (5).

The polarizer (4*a, b*) shown in FIG. 3 is embodied as a meander polarizer. As one skilled in the art knows, however, there are many other possible embodiments of polarizers for electromagnetic waves which are capable of transforming a circularly polarized wave into a linearly polarized wave.

For the holder (3), dielectric materials, such as low-density closed-cell foams, which have very low RF losses, can be used, as can plastic materials such as polytetrafluoroethylene (Teflon) or polyimides.

Because of the size of the phase control element, which particularly at frequencies above 10 GHz is small, in the range of one wavelength, the RF losses with corresponding impedance adaptation are very slight here as well.

On the basis of the following figures, the mode of operation of the invention will be explained by means of a plurality of exemplary embodiments.

In FIG. 4, an antenna element (6) is shown schematically in an exemplary use; upstream of it is a phase controller according to the invention.

In the sending mode, the signal is fed into the waveguide piece (2) via an input coupling (31). The signal then passes through the phase control element (1) and is conducted via the output coupling (32) to the antenna element (6). With the aid of the drive (2), which with the aid of the connecting element (33) rotates the phase control element (1) in the waveguide, the phase position of the signal that is emitted by the antenna element (6) can be adjusted arbitrarily.

Since because of its construction the phase control according to the invention functions entirely reciprocally, the processing of a reception signal is done in the same way: The signal received by the antenna element (6) is fed into the waveguide with the aid of the input coupling (31). The signal then passes through the phase control element (1) and is output-coupled from the waveguide with the output coupling (32). The phase of the reception signal can again be adjusted arbitrarily with the aid of the drive (2). A reception amplifier can also be mounted directly on the output coupling (32) for instance in order to compensate for feed network losses.

The connecting element (33) is designed here as a shaft and preferably consists of a nonmetallic, dielectric material, such as plastic. This has the advantage that cylindrical void modes are interfered with not at all or only very slightly if the shaft is mounted symmetrically in the waveguide.

The input coupling structure (31) and the output coupling structure (32) can, as shown in FIG. 4, be designed as a loop, so that a cylindrical void mode is induced directly. However, embodiments are also conceivable in which two signals with orthogonally located styluses are input- and output-coupled. The phase position of the two signals is then such that a cylindrical void mode is induced as well. The form of the waveguide is preferably a hollow cylinder.

A further embodiment of the invention is schematically shown in FIG. 5. The phase control element (1) consists of the two polarization chips (4*a*, 4*b*) and the holder (3) and is mounted in a cylindrical waveguide piece (50). The holder (3) is fixedly connected to the waveguide piece (50). The waveguide piece (50) is placed in a further cylindrical waveguide (51) in such a way that the waveguide piece (50), in which the phase control element (1) is located, can rotate freely about the waveguide axis (52). A drive unit (2) has a roller (53), so that the waveguide piece (50) and thus the phase control element (1) as well can be rotated by the drive unit (2).

If a cylindrical waveguide mode now travels through the waveguide (51), whereupon because of reciprocity of the function of the phase control according to the invention, the propagation direction does not matter, then a phase angle is impressed on this waveguide mode, which angle depends linearly on the angular position of the phase control element. By rotation of the waveguide piece (50) and thus of the phase control element (1) with the aid of the drive unit (2), this phase angle can be adjusted arbitrarily.

In the embodiment shown in FIG. 6, the holder (3) is embodied as a dielectric packing material, which completely fills the waveguide piece (50), and in which the polarizers (4*a*, 4*b*) are embedded. The waveguide piece (50) is equipped with an external gear ring (54), so that via the gear wheel coupling (55), the drive unit (2) of the waveguide piece (50) together with the phase control element (1) can rotate.

The polarizers (4*a*, 4*b*) are embodied here as two pairs. This can have the advantage of higher polarization uncoupling and/or greater frequency bandwidth. The polarizers of a pair have a spacing from one another of substantially less than one wavelength. The two pairs are spaced apart from one another by approximately half of the wavelength, to reduce coupling of the two polarizers.

For applications in the frequency range above 20 GHz, embodiments which have more than 4 polarizers can furthermore be advantageous.

If the holder is embodied as a dielectric packing material, which completely fills one waveguide piece, then it is also conceivable to metallize the dielectric packing material on its outside, where it touches the waveguide piece (50). This is advantageous if the component is meant to be very lightweight, since then the waveguide piece (50) can be dispensed with.

Embodiments are also conceivable in which the conversion of the signal polarization is done not by planar polarizers or polarization chips but rather, for instance, by structures distributed spatially in the holder (such as septum polarizers). For the function of the invention, the only criterion is that these structures first transform an incident circularly polarized wave into a linearly polarized wave and then can transform it back into a circularly polarized wave.

The embodiments shown in FIGS. 4, 5 and 6 can typically be integrated into the feed networks of antenna arrays without problems, because they require little space. At a frequency of 20 GHz, for example, the dimensions are typically in the range of less than one wavelength, that is, about 1 cm×1 cm. If the holder (3) is designed as a dielectric packing material and the dielectric constant is selected as suitably large, then much smaller structural volumes can be achieved. The ohmic losses do rise slightly then, but are still merely in the percentage range.

The weight of the controllable phase control element is also typically very low. If the polarizers are embodied by thin-film technology on thin RF substrates, and if the holder is made from closed-cell foam, then the weight of the phase control element amounts to typically only a few grams. For the drive unit as well, only very small, lightweight actuators, such as micro electric motors, are therefore necessary. The weight of such micro electric motors is again in the gram range. The weight of an individual phase controller, particularly in the frequency range above 10 GHz, is then typically only a few grams.

Another advantage is that dissipation of the phase controllers of the invention is very slight. The heat input of the phase control elements is negligible because of the very low ohmic losses. If electric motors are used as drive units, then their efficiency is typically >95%, so that the drive units, too, engender practically no heat input. Furthermore, the power consumption, of micromotors, for instance, is merely in the mW range.

A further advantageous embodiment of the invention is shown in FIG. 7. The holder (3) here is embodied as a star-shaped packing material with a cylindrical outer contour. Additionally, four slits for the pairs of polarizers (4*a*, 4*b*) are provided, as well as a central bore for the shaft (56).

The advantage lies in the ease of manufacture. The polarizers (4*a*, 4*b*) can be glued directly into the slits in the holder (3), which without further method steps results in a phase control element (1) according to the invention. The shaft (56) can also be glued directly into a bore in the holder (3) and connected to the drive unit (2).

It is furthermore conceivable that the shaft (56) is itself the shaft of an electric motor, which thus produces the required connection to the phase control element (1) directly and hence can meet all functional requirements.

Still other dielectric packing materials, for example cylindrical or with a triangular or cross-shaped cross section, are also conceivable.

A further development of the invention for direct processing of linearly polarized signals is shown in FIG. 8. The further development provides that mounted upstream of the phase control element (1) is at least one further polarizer (41), which can transform linearly polarized signals into circularly polarized signals, and at least one further polarizer (42) is mounted downstream of the phase control element (1) and can transform circularly polarized signals into linearly polarized signals.

The phase control element (1) according to the invention further consists of the holder (3) and the polarizers (4) and has a drive unit (2), which is designed, and is connected to the phase control element (1) or to the holder (3), such that the holder (3) and/or the phase control element (1) can be rotated.

The way the further development of the invention functions is shown in FIG. 9. An incident linearly polarized wave (7*a*) with a phase position $\varphi$ is transformed by the polarizer (41) mounted upstream of the phase control element (1) into a signal with circular polarization (7*b*). The wave with circular polarization (7*b*) then strikes the rotatable phase control element (1) and is transformed by the polarizer (4*a*) into a linearly polarized wave (7*c*). If the phase control element is rotated, then the field vector (or the E- and H-field vectors) of the linear polarization (7*c*) accordingly also rotates in a plane perpendicular to the propagation direction of the wave. The thus spatially rotated linearly polarized signal is then transformed by the polarizer (4*b*) into a circularly polarized signal (7*d*), whose phase position now depends linearly on the rotation of the phase control element. If the phase control element is rotated about an angle $\Delta\theta$, then the circular wave (7*d*) has the phase position $\varphi+2\Delta\theta$. The double change $2\Delta\theta$ is dictated by the co-rotation of the polarizers (4*a*) and (4*b*). The circularly polarized signal (7*d*) with the phase angle $\varphi+2\Delta\theta$ is finally transformed by the polarizer (42) back into a signal with linear polarization (7*e*), which then likewise has the phase position $\varphi+2\Delta\theta$.

The position of the vector of the linear polarization of the wave (7*e*) relative to the position of the polarization vector of the incident wave (7*a*) in the plane perpendicular to the propagation direction depends on the relative orientation of the two polarizers (5) and (6). If these are oriented identically, then the polarization vectors of the waves (7*a*) and (7*e*) are identical. If conversely the polarizers (5) and (6) are oriented differently, then the polarization vectors of the waves (7*a*) and (7*e*) form an angle which is determined by the relative orientation of the polarizers (41) and (42).

It is therefore conceivable, for instance whenever the signal polarization has to be tracked, which can occur in certain mobile antenna applications, to embody one or both polarizers (41) and/or (42) rotatably and to provide them each with its own drive unit.

For instance if the polarizer (41) is designed rotatably with its own drive unit, and the polarizer (42) is not designed rotatably, and the polarizer (41) can be rotated independently of the phase control element (1), then the polarizer (41) can follow along with a rotation of the linear polarization (7*a*) of the incident wave. A novel arrangement is thus created, with the aid of which the signal polarization can be tracked and simultaneously the phase position of the signal can be adjusted.

As shown in FIG. 10, the further development of the invention for construction reasons also functions for two signals with orthogonal linear polarization. Care must merely be taken here to define the convention for the direction of rotation of the phase angle for the right- or left-polarized wave, respectively.

It furthermore becomes clear from FIG. 10 that the function of the phase control of FIG. 1 is independent of whether a left- or right-circular wave is incident. On account of the reciprocity and the linearity of the function, this also applies to any superposition, even if waves of different circularity are incident simultaneously.

In FIG. 11, as an example, a phase-controlled antenna array with four antenna elements is shown, which in its feed network (10) contains controllable phase control elements.

The signals of all antenna elements are joined together via the feed network (10). The control of the drives of the individual phase controllers is done for instance by a microprocessor (11). If the phase controllers are now adjusted with the aid of the microprocessor (11) such that there is a constant relative phase difference $\Delta\varphi$ between the signals of the individual elements, then the main beam of the antenna array points in a defined direction that is dependent on the phase difference $\Delta\varphi$.

Since via the feed networks (10) the amplitude relations of the sent and received signals of the individual antennas are known precisely and additionally via the phase controllers the phase position of each of these signals can be determined precisely, the antenna diagram of the antenna array in every state of the antenna array (that is, even at any arbitrary time) is determined entirely deterministically.

If the requisite computation power is available in the microprocessor (11) or at some other point in the antenna system, it is therefore even possible to calculate the entire antenna diagram analytically at every time with very high precision. Particularly with a view to the regulatory conformity of the antenna diagram typically required in civilian applications, this represents a substantial advantage of arrangements according to the invention.

Even if the antenna arrays contain several thousand individual antennas, as is typically the case for instance in the frequency range above 10 GHz, it is possible with the aid of a Fast Fourier Transform (FFT) for the corresponding antenna diagram to be calculated very precisely with relatively little computation power. Correspondingly fast FFT algorithms are well known.

The embodiments described of FIGS. 1 through 7 apply analogously to the further development of the invention shown in FIGS. 8-10, so that many variations and combinations are possible.

REFERENCE NUMERALS

Phase control element 1
Drive unit 2
Holder 3
Polarizers 4, 4*a*, 4*b*
Axis of rotation 5
Antenna element 6
Feed network 10
Microprocessor 11
Output coupling 31
Input coupling 32
Connecting element 33
Additional polarizers 41, 42
Waveguide piece 50
Waveguide 51
Waveguide axis 52
Roller 53
Gear ring 54
Gear wheel coupling 55
Shaft 56

The invention claimed is:

1. A controllable phase control element (1) for electromagnetic waves having
a drive unit,
a holder, and
at least two polarizers, wherein
the at least two polarizers are mounted on the holder;
each polarizer is designed for converting a circularly polarized signal into a linearly polarized signal, and the drive unit is connected to the holder in such a way that the polarizers can be rotated; and
wherein the holder can be rotated about an axis which is located in the propagation direction of an incident wave.

2. The controllable phase control element of claim 1, wherein the polarizers are mounted on the holder perpendicularly to the propagation direction of an incident wave and parallel to one another.

3. The controllable phase control element of claim 1, wherein at least one of the polarizers and the holder has a form that is rotationally symmetrically to the axis of rotation of the holder.

4. The controllable phase control element of claim 1, wherein the polarizers are designed as meander polarizers or as septum polarizers.

5. The controllable phase control element of claim 1, wherein the holder has a shaft, and this shaft is connected to the drive unit.

6. The controllable phase control element of claim 1, wherein the holder consists of a plastic.

7. The controllable phase control element of claim 1, wherein the holder consists of closed-cell foam.

8. The controllable phase control element of claim 1, having an axially symmetrical form.

9. The controllable phase control element of claim 1, wherein the drive unit includes an electric motor or a piezoelectric motor.

10. The controllable phase control element of claim 1, wherein the drive unit includes an actuator, which contains electroactive materials.

11. The controllable phase control element of claim 1, having an angular position transmitter, which determines the angular position of the holder.

12. The controllable phase control element of claim 1, wherein the holder is mounted in a cylindrical waveguide.

13. The controllable phase control element of claim 12, wherein the holder is fixedly connected to the waveguide, and the waveguide is connected rotatably and is connected to the drive unit located outside the waveguide in such a way that the drive unit can rotate the waveguide and the interior holder.

14. The controllable phase control element of claim 1, wherein the polarizers each comprise at least one polarizer pair, located parallel to one another, and the spacing of these pairs is substantially shorter than the wavelength.

15. The controllable phase control element of claim 1, wherein the spacing of the polarizers amounts to approximately have the wavelength.

16. The controllable phase control element of claim 1, wherein the holder is a dielectric packing material, which is metallized on its outside.

17. The controllable phase control element for electromagnetic waves of claim 1, having two additional polarizers, which are mounted in the propagation direction of an incident wave upstream and downstream, respectively, of the polarizers, and each of the additional polarizers is designed such that it can convert a circularly polarized signal into a linearly polarized signal.

18. The controllable phase control element of claim 17, wherein at least one of the polarizers is designed rotatably and has a drive unit with which it can be rotated independently of the holder.

19. An antenna having a controllable phase control element of claim 1, wherein the controllable phase control element is inserted into a feed structure of the antenna.

* * * * *